US005575670A

United States Patent [19]

Chen et al.

[11] Patent Number: 5,575,670

[45] Date of Patent: Nov. 19, 1996

[54] DUST PROTECTION FOR PCMCIA CARD AND SOCKET

[75] Inventors: Yue-Ming Chen, Novi; G. Clark Fortune, Farmington Hills; Donald M. Stout, Troy, all of Mich.

[73] Assignee: Eaton Corporation, Cleveland, Ohio

[21] Appl. No.: 400,055

[22] Filed: Mar. 6, 1995

[51] Int. Cl.[6] ..... H01R 13/453

[52] U.S. Cl. ..... 439/138; 439/278; 439/374

[58] Field of Search ..... 439/138, 76.1, 439/278, 374; 361/684, 686, 756, 802

[56] References Cited

U.S. PATENT DOCUMENTS

| | | | |
|---|---|---|---|
| 3,205,471 | 9/1965 | Herrmann | 439/631 |
| 5,035,633 | 7/1991 | Kobayashi et al. | 439/138 |
| 5,187,645 | 2/1993 | Spalding et al. | 361/393 |
| 5,397,857 | 3/1995 | Farguhar et al. | 174/52.1 |

FOREIGN PATENT DOCUMENTS

| | | | |
|---|---|---|---|
| 0232792 | 8/1987 | European Pat. Off. | 439/138 |
| 0161683 | 6/1989 | Japan | 439/138 |

OTHER PUBLICATIONS

IBM Technical Disclosure Bulletin, vol. 33, No. 9, Feb. 1991, p. 33.

*Primary Examiner*—Gary F. Paumen
*Assistant Examiner*—T. C. Patel
*Attorney, Agent, or Firm*—Jennifer M. Stec

[57] ABSTRACT

A compliant boot (30) for protecting the electrical connection between a PCMCIA card (14) and receiving socket (18) from dust and other contaminants when used in a harsh or dusty environment such as on-board a refuse collection vehicle.

6 Claims, 1 Drawing Sheet

FIG 1
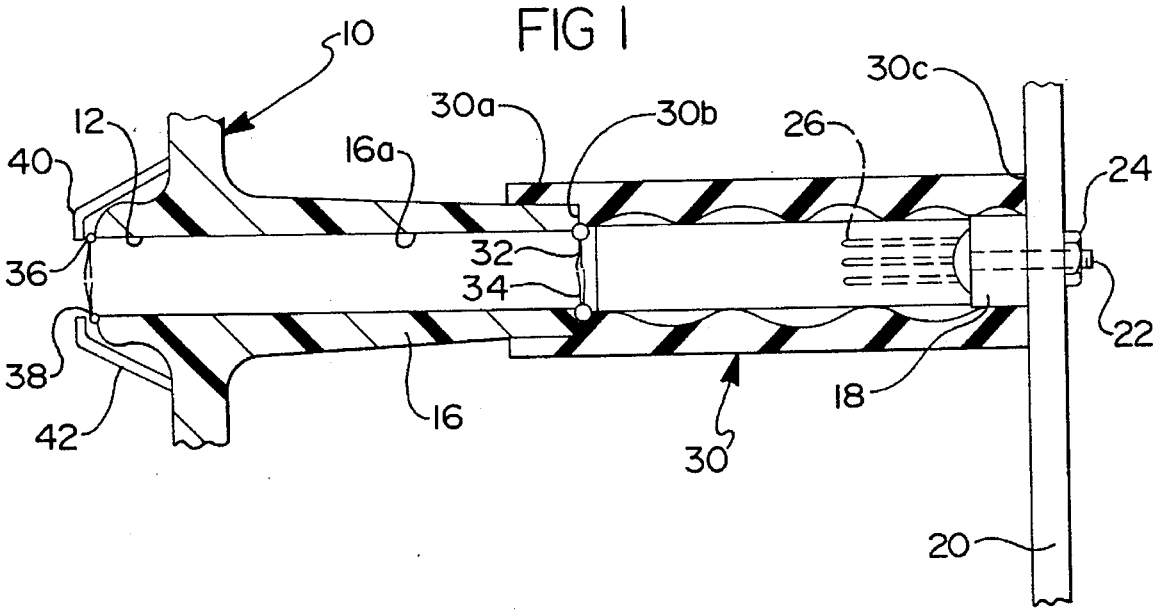
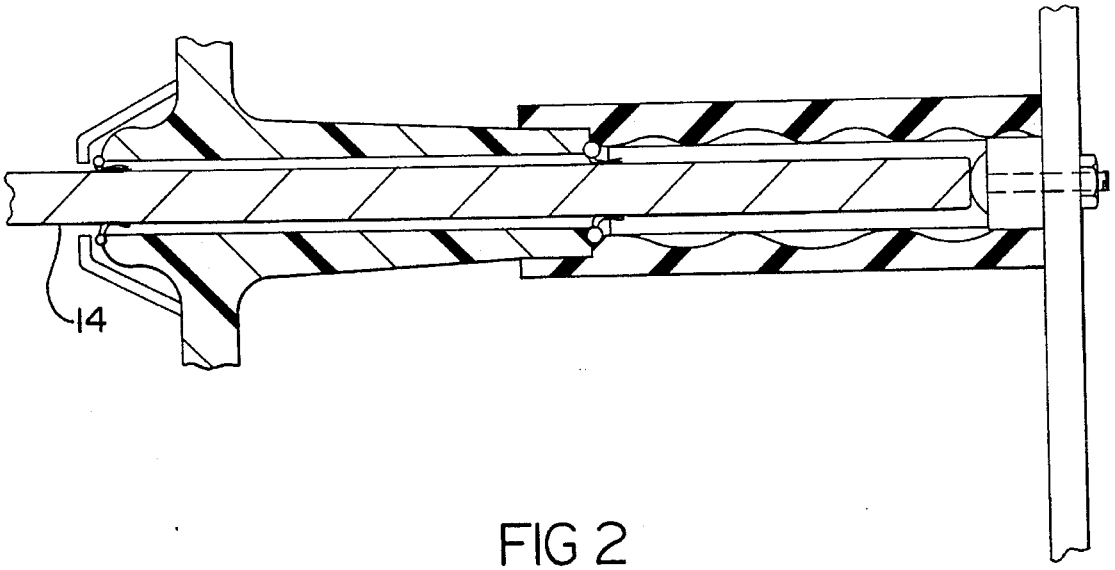
FIG 2

DUST PROTECTION FOR PCMCIA CARD AND SOCKET

BACKGROUND AND SUMMARY OF THE INVENTION

This invention relates generally to electronic data cards and, more particularly, to a dust protection device for a PCMCIA card and socket especially suited for use in a harsh environment such as on-board a refuse collection vehicle.

The development of "credit card" size portable memory devices, such as those made in accordance with standards developed by the Personal Computer Memory Card International Association (PCMCIA), have enabled even greater flexibility in storing and transporting data than heretofore possible. One exemplary use for these data cards is in a vehicle on-board computer (OBC), and in particular, a refuse collection vehicle OBC wherein the card stores data such as route and weight information for later use by a central ground station computer in maximizing vehicle efficiency and automating customer billing procedures.

However, because PCMCIA cards and their peripheries have been developed, at least initially, for use in the relatively clean environments in which personal and laptop computers are typically used, they generally do not afford much protection for the fine pitch connector and socket that is often used to interface the card to the computer. Although this connection is usually made within an enclosed housing, the housing provides insufficient protection in dirty or dusty environments wherein dust and other airborne contaminants can be blown into the housing or otherwise carried in on a surface of a card as it is being inserted. These contaminants can collect on the socket connectors and thereby interfere with and degrade the integrity of sensitive electrical connections to the PCMCIA card.

The present invention provides a simple solution to this problem in the form of a compliant protective boot which fits around the PCMCIA card and receiving socket. The boot extends to the enclosed housing thereby substantially surrounding the card and socket within the housing. A pair of brushes extend toward one another within the boot to allow passage of the card therethrough while preventing the entrance of dust and other contaminants into the boot.

This invention thus enables application of PCMCIA cards in environments more harsh than those in which laptop and other such computers are typically used, such as in industrial and on-board vehicle applications. This thereby enhances the functionality and adaptability of such portable data cards. These and other features and advantages of the invention will become apparent upon review of the following description taken in conjunction with the accompanying drawings.

BRIEF DESCRIPTION OF THE DRAWINGS

FIG. 1 is a partial cross-sectional view of the present invention as installed, when the PCMCIA card is not present.

FIG. 2 is a cross-sectional view similar to FIG. 1 but illustrating the invention in use protecting an inserted card.

DETAILED DESCRIPTION OF THE PREFERRED EMBODIMENT

Turning now to the drawings, and in particular to FIG. 1, an enclosed housing of a computer, preferably an on-board computer which is to read data from and/or store data on a portable memory card, is indicated generally at 10. Housing 10 preferably has formed therein a PCMCIA card guide slot 12, into which a PCMCIA card 14 (see FIG. 2) is to be inserted. While the present invention is described herein in conjunction with use of a PCMCIA card in an on-board vehicle application, it should become readily apparent that the present invention is equally well suited for use with any other type, of data card in any similar application.

Attached to housing 10, or formed integrally therewith in the manner illustrated in the figures, an elongated guide member 16 preferably extends inwardly from slot 12. Guide member 16 is preferably formed so as to be substantially rectangular In cross-sectional shape and to have an inner periphery 16*a* which is only slightly larger than the outer periphery of card 14 so as to enable the guidance of card 14 therethrough by feel, directly toward a receiving socket 18.

Socket 18 is adapted to receive card 14, such as via mating connectors, and is preferably secured to a backplane such as a printed circuit board (PCB) 20 fixedly held within housing 10. Socket 18 may be secured to board 20 such as via a bolt 22 and washer 24, or by any other suitable method known to those having skill in the art.

Since the PCMCIA standard primarily defines the physical dimensions of a card, specific means for interconnecting the card to a computer may vary somewhat and socket 18 may include one or more projecting conductors 26 for contacting corresponding conductors on card 14. However, the present invention is designed to function with any of a wide variety of card to socket connection configurations.

The dust protection means of the present invention primarily includes a boot 30 positioned Within housing 10 so as to substantially surround socket 18, essentially extending guide member 16 all the way to PCB 20. Boot 30, preferably made of a relatively soft compliant material such as rubber, enables an effective snug fit between guide member 16 and PCB 20 without necessitating that boot 30 be made to a tight tolerance.

Boot 30 is affixed to PCB 20 by any suitable fashion, and may also be secured to the outer periphery of socket 18 if desired. Boot 30 is also attached to guide member 16, in the present exemplary embodiment via an extending portion 30*a* which extends beyond a shoulder 30*b* spaced from end 30*c* so as to be compressed between guide member 16 and PCB 20. Additional means such as an adhesive may also be employed to securely bond boot 30 to guide member 16, socket 18 or PCB 20.

Boot 30 also has preferably attached thereto a pair of opposing strip brushes 32 and 34. Each of these strips preferably include bristles which contact one another when no card has been inserted in order to prevent the ingress of dust or any other such contaminants into boot 30 and toward socket 18. However, other means for accomplishing the same function such as strips of felt, soft rubber or any other suitable materials known to those having skill in the art could alternately be used. These could be attached to opposing surfaces of boot 30 or alternately extend around the entire inner periphery. Brushes 32 and 34 may be affixed to boot 30 in any suitable fashion such as adhesive or press fit between shoulder 30*b* and guide member 16.

In order to further prevent the ingress of contaminants into guide member 16, similar strip brushes 36 and 38 may also be provided at the end thereof. Like brushes 32 and 34, brushes 36 and 38 preferably have contacting bristles or other similar means which allow passage of a PCMCIA card 14 therethrough while preventing the entrance of airborne contaminants. Brushes 36 and 38 can be held securely to guide member 16 such as via snap-on clip 40 or any other suitable retaining means known to those having skill in the art.

Turning now to FIG. 2, the present invention is shown in a position wherein PCMCIA card 14 has been inserted into slot 16, through boot 30 and into electrical contact with socket 18 and PCB 20. As card 14 is inserted the bristles of brushes 36 and 38, as well as those of brushes 32 and 34, are pushed inwardly but remain biased toward card 14 in order to seal off airborne contaminants as well as remove dust and other debris from the upper and lower surfaces of card 14. Bristles on each side of card 14 remain straight so as to block ingress along the edges of card 14 as well.

Thus the present invention provides a convenient means for helping to keep electrical connections made between a PCMCIA or similar data card and a receiving socket free from dust and other contamination. The invention is easily adaptable to a wide variety of card, guide slot and socket configurations.

The foregoing discussion discloses and describes an exemplary embodiment of the present invention. One skilled in the art will readily recognize from such discussion, and from the accompanying drawings and appended claims, that certain changes, modifications and variations can be made therein without departing from the spirit and scope of the invention as defined by the following claims.

What is claimed is:

1. An apparatus for protecting the electrical connection between a portable data card and a receiving socket, wherein said socket is housed in an enclosed housing and said data card is inserted through an opening formed in said housing, said apparatus comprising:

a compliant boot extending from said housing opening to said socket, said data card being substantially surrounded by said boot within said housing; and a pair of extending members disposed opposite one another within said boot and being biased into contact with one another, said members allowing said card to pass therethrough.

2. The apparatus of claim 1 wherein said boot is made of a rubber.

3. The apparatus of claim 1 wherein said extending members comprise strips of flexible bristles.

4. The apparatus of claim 1 further comprising a second pair of extending members disposed at said housing opening.

5. The apparatus of claim 1 further comprising a guide slot extending from said housing opening toward said socket, said boot being disposed between said guide slot and said socket.

6. The apparatus of claim 4 wherein said second pair of opposing members comprise strips of flexible bristles.

* * * * *